US006335133B1

(12) United States Patent
Nagasaka

(10) Patent No.: US 6,335,133 B1
(45) Date of Patent: Jan. 1, 2002

(54) ELECTROPHOTOGRAPHIC PHOTOSENSITIVE MEMBER, PROCESS CARTRIDGE, AND ELECTROPHOTOGRAPHIC APPARATUS

(75) Inventor: Hideaki Nagasaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/527,614

(22) Filed: Mar. 17, 2000

(30) Foreign Application Priority Data

Mar. 19, 1999 (JP) ..... 11-075417

(51) Int. Cl.[7] ..... G03G 15/04

(52) U.S. Cl. ..... 430/64; 430/65; 399/116; 399/174

(58) Field of Search ..... 430/64, 65; 399/174, 399/116

(56) References Cited

U.S. PATENT DOCUMENTS

| | | | | | |
|---|---|---|---|---|---|
| 3,745,005 | A | * | 7/1973 | Yoerger et al. | 96/1.5 |
| 4,133,684 | A | * | 1/1979 | Tarumi et al. | 96/1.5 R |
| 4,256,822 | A | * | 3/1981 | Tarumi et al. | 430/62 |
| 5,188,916 | A | * | 2/1993 | Hodumi et al. | 430/65 |
| 5,286,591 | A | * | 2/1994 | Hongo | 430/64 |
| 5,372,904 | A | * | 12/1994 | Yu et al. | 430/65 |
| 5,449,573 | A | | 9/1995 | Aoki et al. | 430/131 |
| 5,635,324 | A | * | 6/1997 | Rasmussen et al. | 430/64 |
| 5,698,355 | A | | 12/1997 | Imai et al. | 430/60 |
| 5,789,127 | A | | 8/1998 | Yamaguchi et al. | 430/64 |
| 5,795,690 | A | | 8/1998 | Takegawa et al. | 430/58 |
| 5,846,679 | A | * | 12/1998 | Kitahara et al. | 430/65 |

FOREIGN PATENT DOCUMENTS

| | | | | |
|---|---|---|---|---|
| EP | 0497523 | | 8/1992 | |
| EP | 0718699 | | 12/1994 | |
| JP | 26141 | * | 4/1973 | |
| JP | 30936 | * | 4/1973 | |
| JP | 47344 | * | 7/1973 | |
| JP | 10044 | * | 1/1974 | |
| JP | 126149 | * | 11/1976 | |
| JP | 10138 | * | 1/1977 | |
| JP | 20836 | * | 2/1977 | |
| JP | 25638 | * | 2/1977 | |
| JP | 89435 | * | 8/1977 | |
| JP | 100240 | * | 8/1977 | |
| JP | 121325 | * | 10/1977 | |
| JP | 48523 | * | 5/1978 | |
| JP | 26738 | * | 2/1979 | |
| JP | 103556 | * | 8/1980 | |
| JP | 60448 | * | 5/1981 | |
| JP | 95351 | * | 6/1983 | |
| JP | 94057 | * | 5/1986 | |
| JP | 63-236051 | * | 9/1988 | 430/65 |
| JP | 189559 | * | 7/1990 | |
| JP | 48256 | * | 3/1991 | |
| JP | 22966 | * | 1/1992 | |
| JP | 31576 | * | 5/1992 | |
| JP | 31577 | * | 5/1992 | |

* cited by examiner

*Primary Examiner*—Mark Chapman
(74) *Attorney, Agent, or Firm*—Fitzpatrick, Cella, Harper & Scinto

(57) ABSTRACT

An electrophotographic photosensitive member capable of exhibiting stable potential characteristics and image forming performances under wide ranges of environmental conditions, is formed of an electroconductive support, and an intermediate layer and a photosensitive layer disposed in this order on the electroconductive support. The intermediate layer comprises a thermosetting resin and an organometallic compound, which may comprise a polymerizate of a compound represented by formula (1) below:

$$(RO)_m—M—(L)_n \quad (1),$$

wherein R denotes an alkyl group; M denotes aluminum, titanium, zirconium, germanium or silicon; L denotes an organic group; m and n are integers of at least 0 giving m+n=3 in case of M being aluminum and m+n=4 in case of M being titanium, zirconium, germanium or silicon.

12 Claims, 1 Drawing Sheet

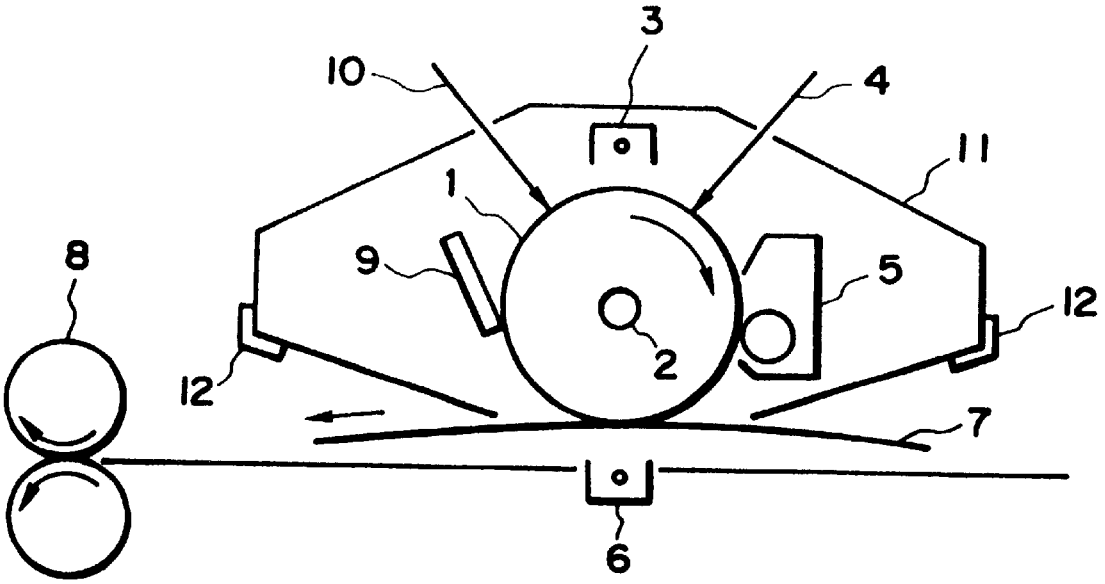
3
10
4
11
1
8
9
5
12
2
12
7
6

ELECTROPHOTOGRAPHIC PHOTOSENSITIVE MEMBER, PROCESS CARTRIDGE, AND ELECTROPHOTOGRAPHIC APPARATUS

FIELD OF THE INVENTION AND RELATED ART

The present invention relates to an electrophotographic photosensitive member, and also a process cartridge and an electrophotographic apparatus including such a photosensitive member.

An electrophotographic photosensitive member basically comprises a photosensitive layer to be charged and photoexposed to form a latent image thereon, and a support for supporting the photosensitive layer.

The photosensitive layer generates charge carriers on absorbing light energy, and the generated charge carriers are required to quickly move without causing re-combination or being trapped to be extinguished. However, in case where a photosensitive layer is directly formed on a support, the soiling on and the ununiform shape, property and roughness of the support surface are reflected as they are as the irregularity of the photosensitive layer formed thereon, thus resulting in images accompanied with image defects such as white dropout, black spots and density irregularities.

For the above reason and for other purposes, such as improvement of adhesion with the support, protection from electrical break down of the photosensitive layer, and prevention of carrier injection into the photosensitive layer, it has been practiced to dispose an intermediate layer between the support and the photosensitive layer rather than to directly form the photosensitive layer by application on the support.

As materials forming the intermediate layer, polyamides are disclosed in Japanese Laid-Open Patent Application (JP-A) 46-47344, JP-A 52-25638 and JP-A 58-95351; polyesters are disclosed in JP-A 52-20836 and JP-A 54-26738; polyurethanes are disclosed in JP-A 49-10044 and JP-A 53-89435; casein is disclosed in JP-A 55-103556; polypeptide is disclosed in JP-A 53-48523; polyvinyl alcohol is disclosed in JP-A 52-100240; polyvinylpyrrolidone is disclosed in JP-A 48-30936; vinyl acetate-ethylene copolymer is disclosed in JP-A 48-26141; maleic anhydride ester copolymer is disclosed in JP-A 52-10138: and quaternary ammonium salt-containing polymers are disclosed in JP-A 51-126149 and JP-A 56-60448.

These resins are however mostly hygroscopic and the resistivities thereof are remarkably changed depending on environmental humidity. Accordingly, in case where the intermediate layer is formed of such a resin alone, the photosensitive layer is liable to cause an increase in residual potential and changes in electrical properties in low temperature/low humidity environment and high temperature/high humidity environment, so that a sufficient improvement of image defects has not been accomplished.

Accordingly, the use of crosslinked resins as resins having resistivities less affected by environmental changes for the intermediate layer has been proposed. For example, melamine resins are disclosed in JP-A 4-22966, Japanese Patent Publication (JP-B) 4-31576 and JP-B 4-31577; phenolic resin is disclosed in JP-A 3-48256; and epoxy resin is disclosed in JP-A 52-121325. However, a sufficiently low environmental dependence of resistivity has not been achieved by these resins.

On the other hand, as inorganic-type intermediate layers, JP-A 61-94057 has proposed the use of an organometallic compound, and JP-A 2-189559 has disclosed a cured film of zirconium and a silane compound. Such inorganic-type intermediate layers have provided relatively stable electric properties even in environments of high temperature/high humidity and low temperature/low humidity, and a resistivity at a level of stability sufficient to obviate a remarkable increase of residual potential. However, intermediate layers (undercoating layers) disclosed in these references have involved problems that these intermediate layers are of substantially metal oxide films which have poor viscoelasticity, are liable to cause cracks or pores and show inferior adhesion with the support. Moreover, some photosensitive layers have caused problems that the coating liquid thereof is liable to be repelled by such inorganic intermediate layers.

SUMMARY OF THE INVENTION

A generic object of the present invention is to provide an electrophotographic photosensitive member with an intermediate layer having solved the above-mentioned problems.

A more specific object of the present invention is to provide an electrophotographic photosensitive member which shows little change in resistivity even under an environmental change from low temperature/low humidity to high temperature/high humidity and is substantially free from residual potential increase.

Another object of the present invention is to provide an electrophotographic photosensitive member with an intermediate layer which shows a good adhesion with the support and the photosensitive layer and can provide stable image qualities on repetitive use.

Further objects of the present invention are to provide a process cartridge and an electrophotographic apparatus including such an electrophotographic photosensitive member.

According to the present invention, there is provided an electrophotographic photosensitive member, comprising: an electroconductive support, and an intermediate layer and a photosensitive layer disposed in this order on the electroconductive support; wherein said intermediate layer comprises a thermosetting resin and an organometallic compound.

The present invention further provides a process cartridge, comprising: the above-mentioned electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus; and also an electrophotographic apparatus, comprising: an electrophotographic photosensitive member, and charging means, developing means and transfer means respectively disposed opposite to the electrophotographic photosensitive member.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing is a schematic illustration of an electrophotographic apparatus including a process cartridge, which in turn includes an electrophotographic photosensitive member, to which the present invention is applicable.

DETAILED DESCRIPTION OF THE INVENTION

The electrophotographic photosensitive member according to the present invention comprises an electroconductive support, an intermediate layer and a photosensitive layer disposed in this order on the support, and the intermediate layer comprises a cured product of a thermosetting resin and an organometallic compound.

More specifically, in the electrophotographic photosensitive member of the present invention, the intermediate layer may be formed by applying a coating liquid comprising a monomer or oligomer of thermosetting resin and an organometallic compound onto an electroconductive support, and heat-curing the coating liquid layer. The thermosetting resin and the organometallic compound may preferably be mixed in a weight ratio of 2:98 to 80:20, more preferably 5:95 to 60:40. If the thermosetting resin is smaller in amount, the resultant intermediate layer is liable to show a lower adhesion with the support and the photosensitive layer, and if the thermosetting resin is excessive, the resultant photosensitive member is liable to exhibit an increased residual potential. The curing may be effected at a temperature ranging from room temperature to 200° C., and it is preferred to effect heating at least after applying the coating liquid for the intermediate layer. The heating may also be effected simultaneously after forming a charge generation and/or a charge transport layer constituting the photosensitive layer.

The solvent for forming the coating liquid for the intermediate layer may comprise any solvent not having an excessively high boiling point, i.e., 200° C. or higher. Preferred examples of such solvents may include: alcohols having at most 5 carbon atoms, toluene and xylene. The coating liquid may preferably be formed to have a solid matter content (i.e., a content in total of the thermosetting resin and the organometallic compound) of 3–40 wt. %, more preferably 5–30 wt. %, in view of the stability of the coating liquid. The coating liquid may be applied by coating methods, such as dipping, spray coating, spin coating, roller coating, wire bar coating and blade coating. The intermediate layer may preferably be formed in a thickness of 0.05–10 μm, more preferably 0.1–5 μm.

The organometallic compound used in the present invention may be a compound having an organic group and a metal element in its molecule and preferably a compound represented by the following formula (1):

$$(RO)_m—M—(L)_n \quad (1),$$

wherein R denotes an alkyl group; M denotes aluminum, titanium, zirconium, germanium or silicon; L denotes an organic group; m and n are integers of at least 0 giving m+n=3 in case of M being aluminum and m+n=4 in case of M being titanium, zirconium, germanium or silicon.

Examples of the alkyl group R in the formula (1) may include: methyl, ethyl, n-propyl, isopropyl, n-butyl, isobutyl, stearyl, hexyl, nonyl and acetyl. In case of m≧2, a plurality of the alkyl groups R may be identical or different from each other. Among the above, alkyl groups having at most 6 carbon atoms are particularly preferred.

The organic group L may be a group derived from organic compounds, inclusive of: β-diketones, such as acetylacetone and 2,4-heptanedione; keto-esters, such as methyl acetoacetate, ethyl acetoacetate, propyl acetoacetate and butyl acetoacetate; hydroxycarboxylic acids, such as lactic acid, salicylic acid, and malic acid; hydroxycarboxylic acid esters, such as methyl lactate, ethyl lactate, ethyl salicylate, and ethyl malate; glycols, such as octanediol and hexanediol; keto-alcohols, such as 4-hydroxy-4-methyl-2-pentanone; aminoalcohols, such as triethanolamine; and hydrocarbons, such as methane, ethane and benzene (i.e., methyl, ethyl and phenyl groups). In case of n≧2, a plurality of groups L may be identical or different from each other. Among the above, groups derived from β-diketones and keto-esters are particularly preferred.

The metal element M may be selected from aluminum, titanium, zirconium, silicone and germanium. Plural metal elements including at least one metal element of these may also be used. Among these, titanium, zirconium and germanium are particularly preferred.

Some examples of the organometallic compounds represented by the above formula (1) are enumerated below.

Examples of the aluminum compound (M=Al) may include: aluminum butoxide, aluminum butoxide bis(ethyl acetoacetate), aluminum diisopropoxide ethyl acetoacetate, aluminum ethoxide, aluminum hexafluoropentadionate, aluminum isopropoxide, aluminum pentanedionate, aluminum phenoxide, and aluminum methacrylate.

Examples of the titanium compound (M=Ti) may include: titanium butoxide, titanium propoxide, titanium dibutoxide bispentanedionate, titanium ethoxide, titanium ethylhexyloxide, titanium lactate, titanium methacrylate triisopropoxide, 2-methacryloxyethoxytriisopropoxy titanate, titanium methyl phenoxide, titanium oxide bispentanedionate, and titanium trimethyl siloxide.

Examples of the zirconium compound (M=Zr) may include: zirconium butoxide, zirconium ethyl acetoacetate, zirconium triethanolamine, acetylacetonatozirconium butoxide, ethyl acetoacetate zirconium butoxide, zirconium acetate, zirconium oxalate, zirconium lactate, zirconium tetramethylpentanedionate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the silicon compound (M=Si) may include: tetramethoxysilane, vinyltrimethoxysilane, vinyltris(β-methoxyethoxy)silane, γ-methacryloxypropyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, β-(3,4-epoxycyclohexyl) ethyltrimethoxysilane, N-β-(aminoethyl)-γ-aminopropylmethylmethoxysilane, N,N-bis(β-hydroxyethyl)-γ-aminopropylethoxysilane, N-phenyl-γ-aminopropyltrimethoxysilane, and γ-chloropropyltrimethoxysilane.

Examples of the germanium compound (M=Ge) may include: tetrabutoxygermane, tetraethoxygermane, tetraisopropoxygermane, methyltriethoxygermane, methacryloxytriethylgermane, ethyltributhoxygermane, diethyldiethoxygermane and allyltriethylgermane.

The organometallic compounds are known to cause polycondesation to form a three-dimensionally crosslinked structure in the presence of a catalyst, such as an acid, or upon heating.

On the other hand, preferable examples of the thermosetting resin may include: phenolic resin, epoxy resin and melamine resin. These resins may be used singly or in combination of two or more species. Phenolic resins are particularly preferred.

Examples of the phenolic resin may include: condensation products between at least one phenol compound selected from phenol and substituted phenols, such as o-cresol, m-cresol, p-cresol, ethylphenol, isopropylphenol, t-butylphenol, t-aminophenol, hexylphenol, t-octylphenol, cyclohexylphenol, 3-methyl-4-chloro-6-t-butylphenol, isopropylcresol, t-butylcresol, t-amylcresol, hexylcresol, t-octylcresol and cyclohexylcresol, and at least one aldehyde compound selected from aliphatic and aromatic aldehydes, such as formaldehyde, acetaldehyde aerolein, crotonaldehyde and furfural. It is also possible to use a polyhydroxyphenyl resin obtained by polycondensation between pyrogallol or resorcinol and acetone. Commercially available examples of phenolic resin may include "PLYOPHEN" and "SUPER BECKACITE"available from Dai-Nippon Ink Kagaku Kogyo K.K.

Examples of the epoxy resin may include: bisphenol A epoxide; phenolic epoxides, such as novolak-type epoxides, alkylphenol diglycidyl ether, aromatic polyglylcidyl, phenolphthalein epoxide and resorcin epoxide; polyglycol epoxides; ester-type epoxides, such as diglycidyl adipate, diglycidyl phthalate, dimer acid diglycidyl ester, metaglycidyl methacrylate, and polymerizates of these; and N-glycidylamine-type epoxide. Known epoxy hardeners may be used in combination therewith, inclusive of: amine type, polyamino amide type, acids and acid anhydrides, imidazole, mercaptan, and phenolic resin. Commercially available examples of the epoxy resins may include: "CRELADE" available from Hoechst Cellanese K.K., "EPICLON" available from Dai-Nippon Ink Kagaku Kogyo K.K., and "EPIKOTE" available from Shell Kagaku K.K.

Commercially available melamine resins may include: "U-VAN" available from Mitsui Toatsu Kagaku K.K., and "SUPER BECKAMINE" available from Dai-Nippon Ink Kagaku Kogyo K.K.

The reason why the use of an intermediate layer comprising a thermosetting resin and an organometallic compound provides a photosensitive member exhibiting good electrical and image forming properties in any environment and a good adhesion between the support and the photosensitive layer, has not been fully clarified yet but may be considered as follows.

By using a thermosetting resin and an organometallic compound which are both crosslinkable three-dimensionally, the resultant film can assume a very fine-textured film state which structurally exhibits low hygroscopicity. Further, the organic resin component and inorganic component are considered to form a composite structure at molecular levels at parts of bonding therebetween and mutually interstitial texture of respective condensation polymer units, which may contribute to alleviating the crack-formability and adhesion lowering liable to be caused by a film of inorganic component alone. From the viewpoint of resistivity of the intermediate layer of the present invention, an electron conductivity-type inorganic component has been introduced to an organic component regarded as an ionic conductivity-type, this compositional combination is considered to be also effective against an external environmental change in addition to the above-mentioned structural factor.

The electrophotographic photosensitive member according to the present invention has a photosensitive layer on the intermediate layer. The photosensitive layer may assume a single layer structure containing both a charge-generating substance and a charge-transporting substance, or a laminated structure including a charge generation layer containing a charge-generating substance and a charge transport layer containing a charge-transporting substance.

The lamination-type photosensitive layer include a type wherein the charge generation layer and the charge transport layer are disposed in this order above an electroconductive support, and another type wherein reversely the charge transport layer and the charge generation layer are disposed in this order above the electroconductive support.

The charge transport layer of the lamination-type photosensitive layer may be formed by applying a coating liquid formed by dissolving a charge-transporting substance in a solution of a film-forming resin. Examples of the charge-transporting substance may include: polycyclic aromatic compounds having a structural unit of biphenylene, anthracene, pyrene, phenanthrene, etc., in their main chain or side chain; nitrogen-containing compounds, such as indole, carbazole, oxazole and pyrazoline; hydrazone compounds, and styryl compounds. Examples of the film-forming resin may include: polyester, polycarbonate, polystyrene, polymethacrylate, and polyarylate. The charge transport layer may have a thickness of 5–40 $\mu$m, preferably 10–30 $\mu$m.

The charge generation layer of the lamination-type photosensitive layer may be formed by application of a coating liquid formed by dispersing a charge-generating substance in a solution of a film-forming resin or by vacuum deposition of a charge-generating substance onto a support. Examples of the charge-generating substance may include: azo pigments, such as Sudan Red and Dyan Blue; quinone pigments, such as pyrenequinone and anthanthrone; quinocyanine pigments; perylene pigments; indigo pigments, such as indigo and thioindigo; and phthalocyanine pigments. Examples of the film-forming resin may include: polyvinylbutyral, polystyrene, polyvinyl acetate and acrylic resin. The charge generation layer may have a thickness of at most 5 $\mu$m, preferably 0.01–3 $\mu$m.

The photosensitive layer may be surface-coated with a protective layer for the purpose of protection from mechanical damage such as surface scratches and abrasion. Examples of the protective layer-forming material may include: resins, such as polyester, polyacrylate, polyethylene, polystyrene, polybutadiene, polycarbonate, polyamide, polypropylene, polyimide, polyamideimide, polysulfone, polyacryl ether, polyacetal, nylon, acryl, silicone, epoxy, urea, allyl, alkyd, butyral, phenoxy and phosphazene; and thermosetting resins, photocurable resins and electron-beam curable resins, such as acryl-modified epoxy resin, acryl-modified urethane resin and acryl-modified polyester resin. The protective layer may suitably have a thickness on the order of 0.2–10 $\mu$m.

The resinous materials forming the respective layers described above can further contain an additive, such as polytetrafluoroethylene, polyvinylidene fluoride, fluorine-containing graft polymer, silicone-based graft polymer, fluorine-containing block polymer, silicone-based block polymer, or silicone-based oil lubricant, for improving the cleanability and wear resistance.

The protective layer can further contain powder of tin oxide, electroconductive titanium oxide, etc., for the purpose of resistivity control, and an additive, such as an antioxidant or an ultraviolet absorber, for improving the weatherability.

The electrophotographic photosensitive member according to the present invention can be applicable to electrophotographic apparatus in general, inclusive of copying machines, laser beam printers, LED printers, and liquid crystal shutter-type printers, and further to apparatus for display, recording, light-weight printing, plate forming and facsimile apparatus to which electrophotography is applied.

Next, some description will be made on the process cartridge and the electrophotographic apparatus according to the present invention.

The sole FIGURE in the drawing shows a schematic structural view of an electrophotographic apparatus including a process cartridge using an electrophotographic photosensitive member of the invention. Referring to the FIGURE, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is imagewise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 5 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. When a contact charging means is used as the primary charger 3 for charging the photosensitive member 1 uniformly, the pre-exposure means may be omitted, as desired.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, into a process cartridge detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail of the apparatus body.

In the case where the electrophotographic apparatus is used as a copying machine or a printer, for example, the imagewise exposure light 4 may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

Hereinbelow, the present invention will be described more specifically with reference to Examples and Comparative Examples wherein "parts" used for describing a relative amount of a component or a material is by weight unless specifically noted otherwise.

EXAMPLE 1

An aluminum cylinder of 29.92 mm in outer diameter, 28.5 mm in inner diameter and 254 mm in length was coated by dipping with a coating liquid formed by mixing 100 parts of toluene, 100 parts of butanol, 10 parts of aluminum pentanedionate (organometallic compound, "KA080" available from Chisso K.K.) and 10 parts of a phenolic resin ("PYLOPHEN TD-447" available from Dai-Nippon Ink Kagaku Kogyo K.K.), followed by heating for drying at 150° C. for 20 min. to form a 0.5 $\mu$m-thick intermediate layer.

Then, a coating liquid for providing a charge generation layer was prepared by mixing 4 parts of oxytitanium phthalocyanine pigment, 2 parts of polyvinyl butyral resin ("BX-1" available from Sekisui Kagaku Kogyo K.K.) and 4 parts of cyclohexanone, dispersing the mixture liquid for 8 hours in a sand mill for 8 hours, and adding thereto 60 parts of tetrahydrofuran. The coating liquid was applied by dipping onto the intermediate layer and heated for drying at 95° C. for 10 min. to form a 0.2 $\mu$m-thick charge generation layer.

Then, a solution of a triarylamine compound of the following formula (2):

(2)

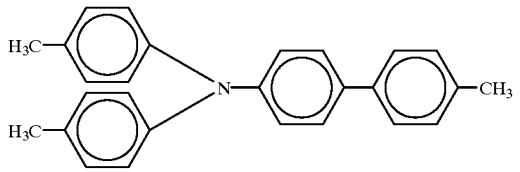

and 50 parts of bisphenol Z-type polycarbonate resin in 400 parts of monochrolobenzene, was applied by dipping onto the charge generation layer and heated for drying at 110° C. for 1 hour to form a 20 $\mu$m-thick charge transport layer, thereby forming an electrophotographic photosensitive member.

EXAMPLE 2

An electrophotographic photosensitive member was prepared in the same manner as in Example 1 except for using 15 parts of 73 wt. % solution in butanol of titanium dibutoxide bispentane-dionate ("AKT853" available from Chisso K.K.) as a source of organometallic compound instead of the 10 parts of aluminum pentanedionate in the coating liquid for the intermediate layer.

EXAMPLE 3

An electrophotographic photosensitive member was prepared in the same manner as in Example 1 except for using 10 parts of zirconium tetramethylpentanedionate ("AKZ971" available from Chisso K.K.) as the organometallic compound instead of the aluminum pentanedionate and 100 parts of hexane instead of the toluene in the coating liquid for the intermediate layer.

EXAMPLE 4

An electrophotographic photosensitive member was prepared in the same manner as in Example 1 except for using 10 parts of methyltriethoxysilane ("SIM6555.0" available from Chisso K.K.) as the organometallic compound instead of the aluminum pentanedionate in the coating liquid for the intermediate layer.

EXAMPLE 5

An electrophotographic photosensitive member was prepared in the same manner as in Example 1 except for using 10 parts of methyltriethoxygermane ("GEM6550" available from Chisso K.K.) as the organometallic compound instead of the aluminum pentanedionate in the coating liquid for the intermediate layer.

EXAMPLE 6

An electrophotographic photosensitive member was prepared in the same manner as in Example 1 except for using an epoxy resin ("EPIKOTE 828" available from Shell Kagaku K.K.) instead of the phenolic resin in the coating liquid for the intermediate layer.

EXAMPLE 7

An electrophotographic photosensitive member was prepared in the same manner as in Example 2 except for using an epoxy resin ("EPIKOTE 828" available from Shell Kagaku K.K.) instead of the phenolic resin in the coating liquid for the intermediate layer.

EXAMPLE 8

An electrophotographic photosensitive member was prepared in the same manner as in Example 3 except for using an epoxy resin ("EPIKOTE 828" available from Shell Kagaku K.K.) instead of the phenolic resin in the coating liquid for the intermediate layer.

EXAMPLE 9

An electrophotographic photosensitive member was prepared in the same manner as in Example 4 except for using an epoxy resin ("EPIKOTE 828" available from Shell Kagaku K.K.) instead of the phenolic resin in the coating liquid for the intermediate layer.

EXAMPLE 10

An electrophotographic photosensitive member was prepared in the same manner as in Example 5 except for using an epoxy resin ("EPIKOTE 828" available from Shell Kagaku K.K.) instead of the phenolic resin in the coating liquid for the intermediate layer.

EXAMPLE 11

An electrophotographic photosensitive member was prepared in the same manner as in Example 1 except for using a melamine resin "U-VAN 2020" available from Mitsui Toatsu Kagaku K.K.) instead of the phenolic resin in the coating liquid for the intermediate layer.

EXAMPLE 12

An electrophotographic photosensitive member was prepared in the same manner as in Example 2 except for using a melamine resin "U-VAN" 2020 available from Mitsui Toatsu Kagaku K.K.) instead of the phenolic resin in the coating liquid for the intermediate layer.

EXAMPLE 13

An electrophotographic photosensitive member was prepared in the same manner as in Example 3 except for using a melamine resin "U-VAN 2020" available from Mitsui Toatsu Kagaku K.K.) instead of the phenolic resin in the coating liquid for the intermediate layer.

EXAMPLE 14

An electrophotographic photosensitive member was prepared in the same manner as in Example 4 except for using a melamine resin "U-VAN 2020" available from Mitsui Toatsu Kagaku K.K.) instead of the phenolic resin in the coating liquid for the intermediate layer.

EXAMPLE 15

An electrophotographic photosensitive member was prepared in the same manner as in Example 5 except for using a melamine resin "U-VAN 2020" available from Mitsui Toatsu Kagaku K.K.) instead of the phenolic resin in the coating liquid for the intermediate layer.

EXAMPLE 16

An electrophotographic photosensitive member was prepared in the same manner as in Example 1 except for reducing the amount of the phenolic resin to 2 parts and adding 8 parts of an epoxy resin ("EPIKOTE 828" available from Shell Kagaku K.K.) in the coating liquid for the intermediate layer.

EXAMPLE 17

An electrophotographic photosensitive member was prepared in the same manner as in Example 1 except for reducing the amount of the phenolic resin to 2 parts and adding 8 parts of a melamine resin ("U-VAN 2020", available from Mitsui Toatsu Kagaku K.K.) in the coating liquid for the intermediate layer.

EXAMPLE 18

An electrophotographic photosensitive member was prepared in the same manner as in Example 6 except for reducing the amount of the epoxy resin to 5 parts and adding 5 parts of a melamine resin ("U-VAN 2020, available from Mitsui Toatsu Kagaku K.K.) in the coating liquid for the intermediate layer.

Comparative Example 1

An electrophotographic photosensitive member was prepared in the same manner as in Example 1 except for omitting the organometallic compound from the coating liquid for the intermediate layer.

Comparative Example 2

An electrophotographic photosensitive member was prepared in the same manner as in Example 6 except for omitting the organometallic compound from the coating liquid for the intermediate layer.

Comparative Example 3

An electrophotographic photosensitive member was prepared in the same manner as in Example 11 except for omitting the organometallic compound from the coating liquid for the intermediate layer.

Comparative Example 4

The preparation of an electrophotographic photosensitive member was tried in the same manner as in Example 4 except for omitting the phenolic resin from the coating liquid for the intermediate layer. On the intermediate layer thus formed, the same coating liquid for the charge generation layer as in Example 4 was applied, but the coating liquid was repelled by the intermediate layer, whereby the preparation of a photosensitive member was failed.

Comparative Example 5

An electrophotographic photosensitive member was prepared in the same manner as in Example 1 except for omitting the phenolic resin from the coating liquid for the intermediate layer.

Comparative Example 6

An electrophotographic photosensitive member was prepared in the same manner as in Example 2 except for omitting the phenolic resin from the coating liquid for the intermediate layer.

Comparative Example 7

An electrophotographic photosensitive member was prepared in the same manner as in Example 1 except for replacing the phenolic resin with a polyvinyl butyral resin "BX-1", available from Sekisui Kagaku Kogyo K.K.) from the coating liquid for the intermediate layer.

Each of the photosensitive members prepared in Examples 1–18 and Comparative Examples 1–3 and 5–7 was incorporated in a commercially available laser beam printer ("Laser Jet 4000", available from Nippon Hewlett Packard K.K.) and was subjected to measurement of dark-part potential, exposed-part potential and image evaluation, respectively, at the initial stage and after continuous image formation on 10000 sheets in each of low temperature/low humidity environment (15° C./10% RH) and high temperature/high humidity environment (30° C./80% RH). The results are inclusively shown in Table 1 (results in the low temperature/low humidity environment) and Table 2 (results in the high temperature/low humidity environment), below, for which tables, the following remarks are added:

1: Black spots observed.

2: Irregularity observed.

3: Large numbers of black spots and irregularities observed.

4: Large number of irregularities observed.

5: Edge peeled.

6: Large number of black spots observed.

TABLE 1

Results in 15° C./10% RH

| Photo-sensitive member | Initial Potential (-V) Dark-part | Initial Potential (-V) Exposed-part | Initial Image quality | After 10,000 sheets Potential (-V) Dark-part | After 10,000 sheets Potential (-V) Exposed-part | After 10,000 sheets Image quality |
|---|---|---|---|---|---|---|
| Ex. 1 | 700 | 180 | good | 700 | 185 | good |
| Ex. 2 | 700 | 185 | good | 700 | 190 | good |
| Ex. 3 | 695 | 190 | good | 695 | 195 | good |
| Ex. 4 | 695 | 180 | good | 700 | 180 | good |
| Ex. 5 | 700 | 175 | good | 705 | 185 | good |
| Ex. 6 | 705 | 180 | good | 700 | 185 | good |
| Ex. 7 | 700 | 185 | good | 700 | 180 | good |
| Ex. 8 | 700 | 185 | good | 700 | 180 | good |
| Ex. 9 | 705 | 185 | good | 700 | 190 | good |
| Ex. 10 | 690 | 180 | good | 700 | 185 | good |
| Ex. 11 | 700 | 185 | good | 695 | 180 | good |
| Ex. 12 | 700 | 185 | good | 700 | 185 | good |
| Ex. 13 | 705 | 185 | good | 700 | 180 | good |
| Ex. 14 | 700 | 185 | good | 700 | 190 | good |
| Ex. 15 | 700 | 190 | good | 700 | 180 | good |
| Ex. 16 | 700 | 185 | good | 700 | 180 | good |
| Ex. 17 | 700 | 180 | good | 700 | 180 | good |
| Ex. 18 | 700 | 185 | good | 700 | 180 | good |
| Comp. Ex. 1 | 700 | 190 | good | 660 | 230 | *3 |
| Comp. Ex. 2 | 680 | 210 | *1 | 640 | 250 | *1 |
| Comp. Ex. 3 | 640 | 190 | *2 | 600 | 220 | *4 |
| Comp. Ex. 4 | Preparation of photosensitive member failed. | | | | | |
| Comp. Ex. 5 | 660 | 200 | *1 | 680 | 230 | *5 |
| Comp. Ex. 6 | 520 | 150 | *1 | 610 | 180 | *1 |
| Comp. Ex. 7 | 680 | 200 | good | 650 | 210 | *1 |

TABLE 2

Results in 30° C./80% RH

| Photo-sensitive member | Initial Potential (-V) Dark-part | Initial Potential (-V) Exposed-part | Initial Image quality | After 10,000 sheets Potential (-V) Dark-part | After 10,000 sheets Potential (-V) Exposed-part | After 10,000 sheets Image quality |
|---|---|---|---|---|---|---|
| Ex. 1 | 705 | 175 | good | 700 | 175 | good |
| Ex. 2 | 700 | 190 | good | 700 | 190 | good |
| Ex. 3 | 695 | 185 | good | 695 | 180 | good |
| Ex. 4 | 695 | 180 | good | 700 | 180 | good |
| Ex. 5 | 695 | 170 | good | 700 | 175 | good |
| Ex. 6 | 705 | 180 | good | 700 | 185 | good |
| Ex. 7 | 700 | 180 | good | 700 | 180 | good |
| Ex. 8 | 700 | 185 | good | 700 | 185 | good |

TABLE 2-continued

| Photo-sensitive member | Results in 30° C./80% RH: Initial, Potential (-V), Dark-part | Initial, Potential (-V), Exposed-part | Initial, Image quality | After 10,000 sheets, Potential (-V), Dark-part | After 10,000 sheets, Potential (-V), Exposed-part | After 10,000 sheets, Image quality |
|---|---|---|---|---|---|---|
| Ex. 9 | 705 | 185 | good | 700 | 180 | good |
| Ex. 10 | 690 | 180 | good | 700 | 190 | good |
| Ex. 11 | 700 | 185 | good | 695 | 185 | good |
| Ex. 12 | 700 | 180 | good | 700 | 175 | good |
| Ex. 13 | 700 | 185 | good | 700 | 180 | good |
| Ex. 14 | 695 | 180 | good | 700 | 180 | good |
| Ex. 15 | 700 | 190 | good | 700 | 190 | good |
| Ex. 16 | 700 | 185 | good | 700 | 180 | good |
| Ex. 17 | 700 | 180 | good | 700 | 180 | good |
| Ex. 18 | 700 | 185 | good | 700 | 180 | good |
| Comp. Ex. 1 | 670 | 190 | *1 | 630 | 150 | *3 |
| Comp. Ex. 2 | 640 | 180 | *1 | 610 | 220 | *1 |
| Comp. Ex. 3 | 640 | 190 | *1 | 600 | 140 | *3 |
| Comp. Ex. 4 | Preparation of photosensitive member failed. | | | | | |
| Comp. Ex. 5 | 660 | 230 | *1 | 690 | 220 | *5 |
| Comp. Ex. 6 | 520 | 130 | *6 | 490 | 100 | *5 |
| Comp. Ex. 7 | 650 | 180 | good | 620 | 150 | *1 |

As shown in the above Tables 1 and 2. The electrophotographic photosensitive members of the present invention exhibited good image quality and stable potential characteristics even after continuous image formation on 10000 sheets in each of the low temperature/low humidity environment and the high temperature/high humidity environment.

What is claimed is:

1. A process cartridge, comprising: an electrophotographic photosensitive member and contact charging means, said electrophotographic photosensitive member and said contact charging means being integrally supported and detachably mountable to a main assembly of an electrophotographic apparatus, wherein said electrophotographic photosensitive member comprises an electroconductive support, and an intermediate layer and a photosensitive layer disposed in this order on the electroconductive support; and said intermediate layer comprises a thermosetting resin and an organometallic compound, said thermosetting resin being selected from the group consisting of phenolic resin, epoxy resin and melamine resin.

2. The process cartridge according to claim 1, wherein said organometallic compound comprises a polymerizate of a compound represented by formula (1) below:

$$(RO)_m—M—(L)_n \quad (1),$$

wherein R is an alkyl group; M is aluminum, titanium, zirconium, germanium or silicon; L is an organic group; m and n are integers of at least 0 giving m+n=3 when M is aluminum and m+n=4 when M is titanium, zirconium, germanium or silicon.

3. The process cartridge according to claim 2, wherein said alkyl group R has at most 6 carbon atoms.

4. The process cartridge according to claim 2, wherein said organic group L is one derived from a compound selected from the group consisting of β-diketones, ketoesters, hydroxycarboxylic acids, hydroxycarboxylic acid esters, glycols, keto-alcohols, amino-alcohols and hydrocarbons.

5. The process cartridge according to claim 4, wherein said organic group L is one derived from β-diketones or keto-esters.

6. The process cartridge according to claim 2, wherein said M is titanium, zirconium or germanium.

7. An electrophotographic apparatus, comprising: an electrophotographic photosensitive member, and contact charging means, developing means and transfer means respectively disposed opposite to the electrophotographic photosensitive member, wherein said electrophotographic photosensitive member comprises an electroconductive support, and an intermediate layer and a photosensitive layer disposed in this order on the electroconductive support; and said intermediate layer comprises a thermosetting resin and an organometallic compound, said thermosetting resin being selected from the group consisting of phenolic resin, epoxy resin and melamine resin.

8. The electrophotographic apparatus according to claim 7, wherein said organometallic compound comprises a polymerizate of a compound represented by formula (1) below:

$$(RO)_m—M—(L)_n \quad (1),$$

wherein R is an alkyl group; M is aluminum, titanium, zirconium, germanium or silicon; L is an organic group; m and n are integers of at least 0 giving m+n=3 when M is aluminum and m+n=4 when M is titanium, zirconium, germanium or silicon.

9. The electrophotographic apparatus according to claim 8, wherein said alkyl group R has at most 6 carbon atoms.

10. The electrophotographic apparatus according to claim 8, wherein said organic group L is one derived from a compound selected from the group consisting of β-diketones, ketoesters, hydroxycarboxylic acids, hydroxycarboxylic acid esters, glycols, keto-alcohols, amino-alcohols and hydrocarbons.

11. The electrophotographic apparatus according to claim 10, wherein said organic group L is one derived from β-diketones or keto-esters.

12. The electrophotographic apparatus according to claim 8, wherein said M is titanium, zirconium or germanium.

* * * * *

UNITED STATES PATENT AND TRADEMARK OFFICE

CERTIFICATE OF CORRECTION

PATENT NO. : 6,335,133 B1
DATED : January 1, 2002
INVENTOR(S) : Hideaki Nagasaka et al.

It is certified that error appears in the above-identified patent and that said Letters Patent is hereby corrected as shown below:

Title page,
Item [56], References Cited, FOREIGN PATENT DOCUMENTS,
"26141" should read -- 48-26141 --;
"30936" should read -- 48-30936 --;
"47344" should read -- 48-47344 --;
"10044" should read -- 49-10044 --;
"126149" should read -- 51-126149 --;
"10138" should read -- 52-10138 --;
"20836" should read -- 52-20836 --;
"25638" should read -- 52-25638 --;
"89435" should read -- 52-89435 --;
"100240" should read -- 52-100240 --;
"121325" should read -- 52-121325 --;
"48523" should read -- 53-48523 --;
"26738" should read -- 54-26738 --;
"103556" should read -- 55-103556 --;
"60448" should read -- 56-60448 --;
"95351" should read -- 58-95351 --;
"94057" should read -- 61-94057 --;
"189559" should read -- 2-189559 --;
"48256" should read -- 3-48256 --;
"22966" should read -- 4-22966 --;
"31576" should read -- 4-31576 --; and
"31577" should read -- 4-31577 --;

Column 1,
Line 28, "break down" should read -- breakdown --; and
Line 30, "practiced" should read -- the practice --.

Column 2,
Line 63, "FIGURE" should read -- figure --.

Column 4,
Line 55, "ethyltributhoxygermane," should read -- ethyltributoxygermane, --; and
Line 58, "condesation" should read -- condensation --.

Column 5,
Line 16, "polyglycidyl," should read -- polyglycidyl, --; and
Line 66, "include" should read -- includes --.

UNITED STATES PATENT AND TRADEMARK OFFICE

CERTIFICATE OF CORRECTION

PATENT NO. : 6,335,133 B1
DATED : January 1, 2002
INVENTOR(S) : Hideaki Nagasaka et al.

It is certified that error appears in the above-identified patent and that said Letters Patent is hereby corrected as shown below:

Column 7,
Line 1, “FIGURE” should read -- figure --; and
Line 4, “FIGURE,” should read -- figure, --.

Column 8,
Line 1, “with” should read -- in --.

Column 10,
Line 62, “was” should be deleted.

Column 13,
Line 26, “and 2. The” should read -- and 2, the --.

Signed and Sealed this

Ninth Day of July, 2002

*Attest:*

*Attesting Officer*

JAMES E. ROGAN
*Director of the United States Patent and Trademark Office*